US008397913B2

(12) United States Patent
Weissbrod

(10) Patent No.: US 8,397,913 B2
(45) Date of Patent: Mar. 19, 2013

(54) SHIPPING PACKAGE WITH END RETAINER AND METHOD THEREFOR

(75) Inventor: Paul A. Weissbrod, South Euclid, OH (US)

(73) Assignee: Lincoln Global, Inc., City of Industry, CA (US)

( * ) Notice: Subject to any disclaimer, the term of this patent is extended or adjusted under 35 U.S.C. 154(b) by 75 days.

(21) Appl. No.: 12/890,839

(22) Filed: Sep. 27, 2010

(65) Prior Publication Data

US 2012/0074015 A1 Mar. 29, 2012

(51) Int. Cl.
*B65D 85/26* (2006.01)
*B65D 85/20* (2006.01)
*B65D 25/00* (2006.01)

(52) U.S. Cl. ..... 206/443; 206/521

(58) Field of Classification Search ..... 206/443, 206/523, 591, 521, 586; 220/254.1, 254.7, 220/256.1, 258.2, 270, 694
See application file for complete search history.

(56) References Cited

U.S. PATENT DOCUMENTS

| | | | | |
|---|---|---|---|---|
| 1,682,179 | A | 8/1928 | Krembs | |
| 3,437,257 | A * | 4/1969 | Bua | 229/123.1 |
| 3,451,586 | A * | 6/1969 | Maliszewski et al. | 220/270 |
| 3,581,883 | A | 6/1971 | Whitney | |
| 3,973,719 | A * | 8/1976 | Johnson et al. | 229/5.6 |
| 4,441,625 | A * | 4/1984 | Andersson | 220/257.1 |
| 4,497,407 | A | 2/1985 | Stager | |
| 4,589,550 | A * | 5/1986 | Stager | 206/443 |
| 5,110,004 | A * | 5/1992 | Albanesi et al. | 426/106 |
| 5,266,772 | A | 11/1993 | Reed | |
| 5,273,176 | A * | 12/1993 | Diaz | 220/258.2 |
| 5,553,708 | A | 9/1996 | Lawrence et al. | |
| 5,573,119 | A | 11/1996 | Luray | |
| 5,657,894 | A * | 8/1997 | Bowen | 220/837 |
| 5,772,037 | A | 6/1998 | Hurley | |
| 5,984,101 | A | 11/1999 | Zamora et al. | |
| 6,047,878 | A * | 4/2000 | Lowry | 229/5.5 |
| 6,220,471 | B1 * | 4/2001 | Lowry | 220/258.2 |
| 6,755,304 | B2 | 6/2004 | Ryals | |
| 6,877,608 | B2 | 4/2005 | Koike | |
| 2003/0222083 | A1 * | 12/2003 | Pladsbjerg | 220/254.3 |
| 2006/0042982 | A1 | 3/2006 | Goodwin, Jr. | |
| 2009/0230140 | A1 * | 9/2009 | Weissbrod | 220/694 |

FOREIGN PATENT DOCUMENTS

| | | |
|---|---|---|
| CN | 201080276 Y | 7/2008 |
| CN | 201144046 Y | 11/2008 |
| DE | 3930336 A1 | 3/1991 |

OTHER PUBLICATIONS

International Search Report for International Patent Application PCT/IB2011/002243. Feb. 2, 2012.

(Continued)

*Primary Examiner* — Steven A. Reynolds
(74) *Attorney, Agent, or Firm* — Hahn Loeser & Parks LLP

(57) ABSTRACT

A shipping package includes a can body having an interior volume and at least one closable end, an end closure closably engaging the closable end of the can body having a recessed portion adapted to fit within a portion of the can body adjacent the closable end, and a disposable reinforcing member corresponding to at least a portion of the recessed portion of the end closure secured adjacent to an exterior surface of the recessed portion.

11 Claims, 8 Drawing Sheets

OTHER PUBLICATIONS

Written Opinion for International Patent Application PCT/IB2011/002243. Feb. 2, 2012.
Machine Translation of DE3930336.
Military Specification; MIL-W-010430D; Packaging of Welding Rods and Electrodes; Mar. 22, 1994; pp. 1-45.
Written Opinion for International Patent Application PCT/IB2011/002243, Oct. 16, 2012.
International Safe Transit Association (ISTA) Test 3A; 3 Series General Simulation Performance Test Procedure, Feb. 2008.

* cited by examiner

SHIPPING PACKAGE WITH END RETAINER AND METHOD THEREFOR

BACKGROUND AND SUMMARY

Many products, including stick electrodes for welding, are shipped in canister shipping packages. During shipping, the packages are typically dropped, thrown, bounced, and otherwise subjected to forces caused by handling.

In the past, when a canister shipping package was dropped or otherwise handled, the contents of the package shifted impacting against the package end cap or end closure. Such movement of the package contents was one cause of the end closure deforming and/or tearing from the package. In certain applications such as stick electrodes for welding, movement of the package contents inside the package in a longitudinal direction cause the contents to impact the end closure. Prior shipping packages could not withstand the shipping forces caused by high density electrode products moving inside the package without deformation and damage to the end closures. There remains a need for improved shipping containers that withstand the forces of shipping and reduce shipping damage to the package contents.

What is disclosed is a shipping package comprising a can body having an interior volume and at least one closable end, an end closure closably engaging the closable end of the can body having a recessed portion adapted to fit within a portion of the can body adjacent the closable end, and a disposable reinforcing member corresponding to at least a portion of the recessed portion secured adjacent an exterior surface of the recessed portion.

DETAILED DESCRIPTION OF THE DRAWINGS

Figure 1:
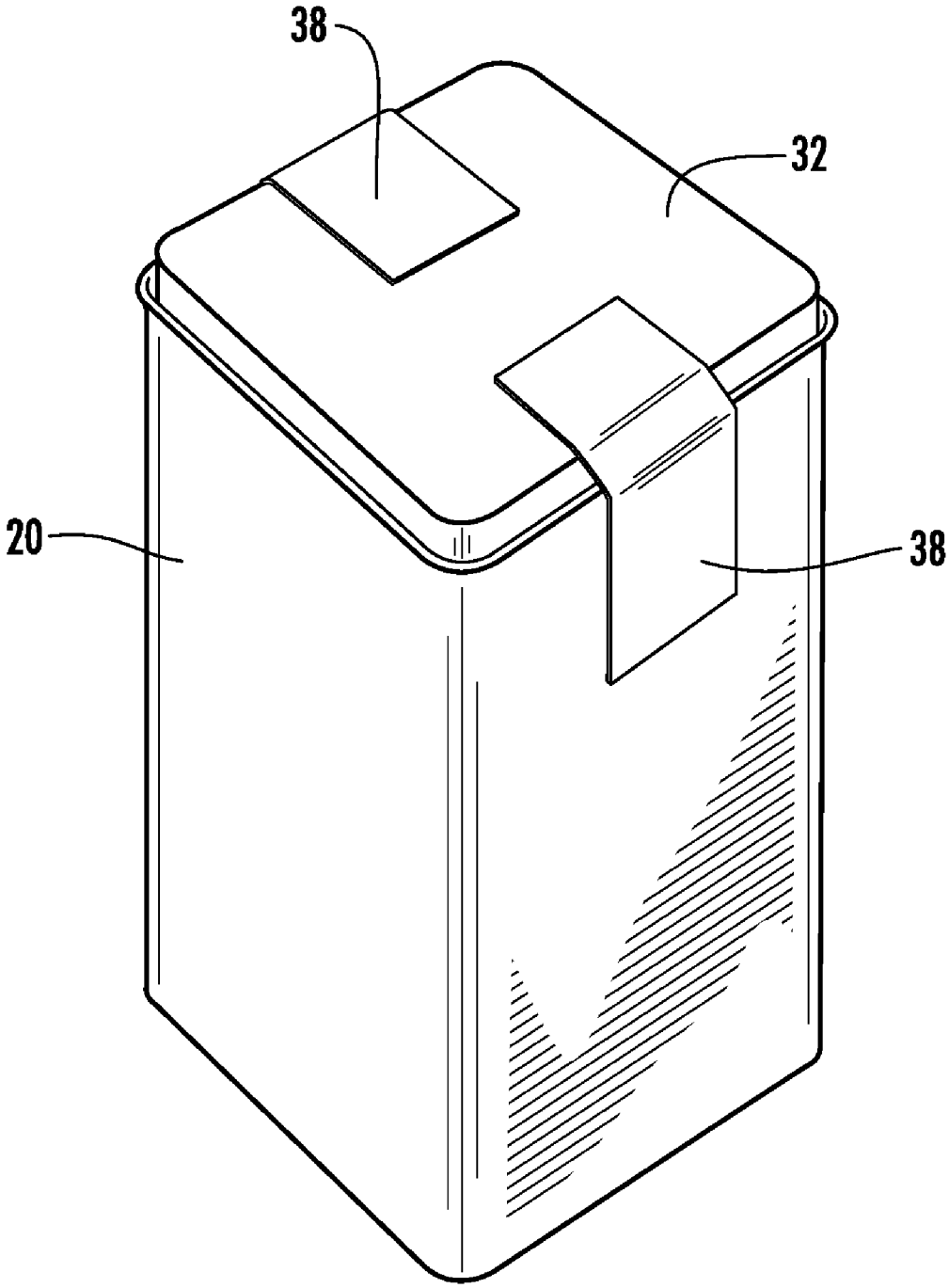
FIG. 1 is a perspective view of a shipping package of the present disclosure.
Figure 2:
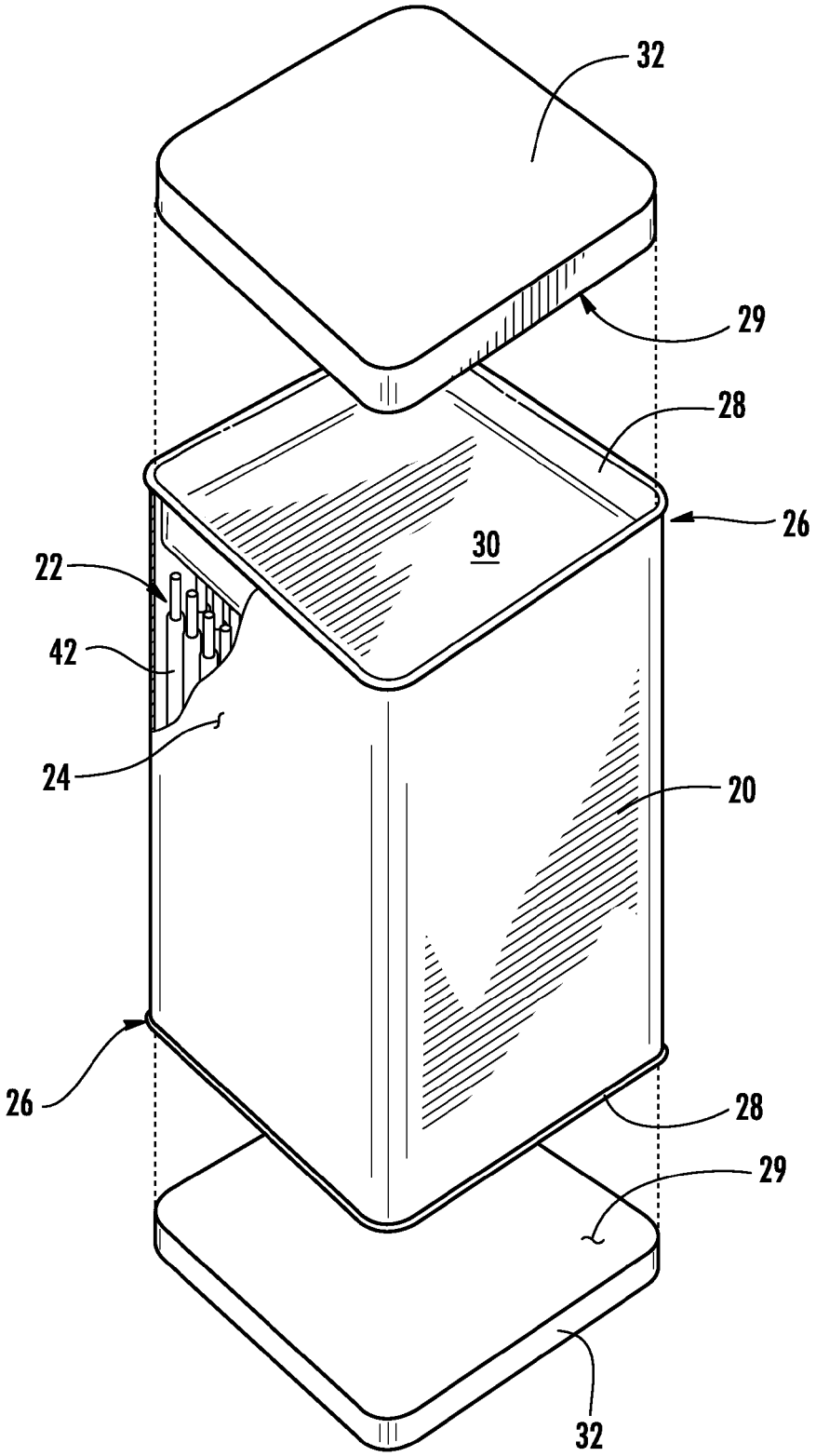
FIG. 2 is an exploded perspective view of the shipping package of FIG. 1.
Figure 3:
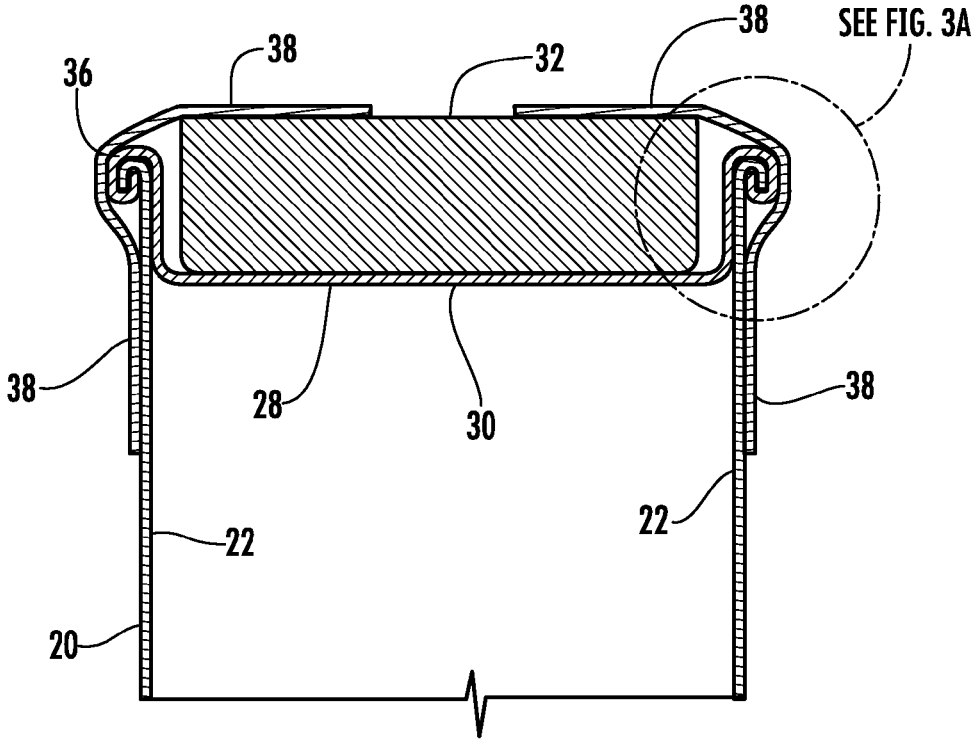
FIG. 3 is a cross sectional view through the end of the shipping package.

Referring now to FIGS. 1 and 2, a shipping package has a longitudinal can body 20 having an inside volume 22 and an outside surface 24 and at least one closable end 26. The closable end 26 is closed using an end closure 28 closably engaging the closable end 26 of the can body 20. A disposable reinforcing member 32 is provided having a support surface 29 corresponding to at least a portion of the end closure 28 and secured adjacent at least a portion of an exterior side of the end closure 28 as shown in FIG. 3. The disposable reinforcing member 32 is positioned such that at least a portion of the support surface 29 is in contacting engagement with at least a portion of the exterior of the end closure 28 and adapted to reinforce the end closure 28 to withstand greater shipping forces than a shipping package without the reinforcing member 32, and particularly may be adapted to resist forces applied by package contents impacting the inside of the recessed portion of the end closure 28. The disposable reinforcing member 32 may be adapted to be removed after shipping of the package for a user to access the end closure 28.

The can body 20 may have a four-sided cross sectional shape as shown in FIGS. 1 and 2. Alternatively, the can body 20 may have a circular cross sectional shape, a triangular cross sectional shape, a hexagonal cross sectional shape, or any other polygonal, arcuate, or other cross sectional shape as desired (not shown).

The end closure 28 engages the can body 20 to close the end. As shown in FIG. 3, the can body 20 may have a flange 34 adjacent the closable end and the end closure 28 may have a flange portion 36 adapted to engage the can flange 34 when seam-sealed together around the perimeter of the end of the can body 20 as is well known by those skilled in the art. The seamed flanges 34, 36 form a rim 37 around the shipping package adjacent the closable end 26. A sealing compound may be provided between the can flange 34 and the closure flange portion 36 to form a hermetically sealed closure on the can body 20.

The end closure 28 may have a planar exterior surface engaging a corresponding planar support surface 29 on the reinforcing member 32. Alternatively, the end closure 28 may have a contoured exterior surface engaging a corresponding contoured support surface 29 on the reinforcing member 32. The end closure 28 may have a recessed portion 30 adapted to fit within a portion of the can body 20 adjacent the closable end 26 as shown in FIG. 3. At least a portion of the disposable reinforcing member 32 corresponding to at least a portion of the recessed portion 30 may be recessed with the end closure 28 into the closable end 26 of the can body 20.

Figure 3A:
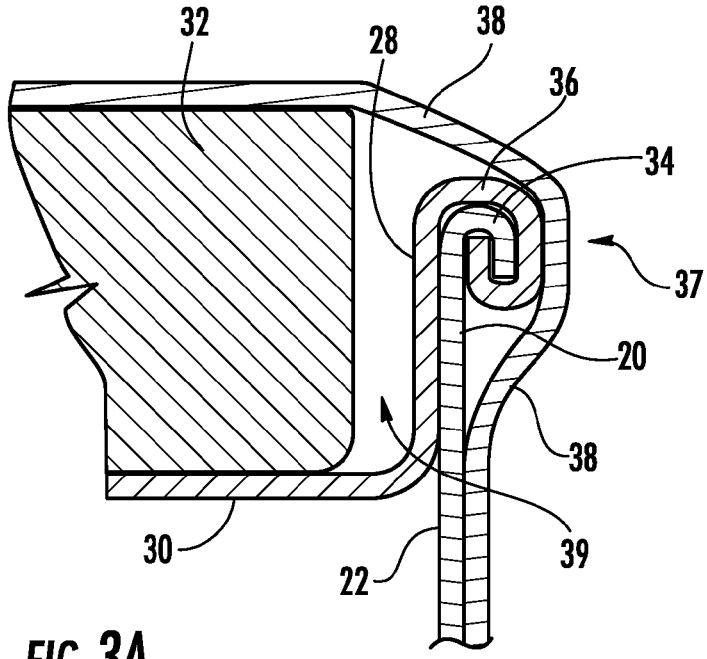
FIG. 3A is a detail of the rim of the shipping package of FIG. 3.

As shown in FIG. 3A, there may be a gap 39 between the edge surface of the reinforcing member 32 and the side surface of the recessed portion 30 adjacent the rim 37. In one exemplary and non-limiting example, the gap 39 may be between about 0 and about 0.01 inch. In an alternative application, the gap 39 may be between about 0 and 0.06 inch, preferably between about 0.01 and 0.03 inch. In yet another alternative, the gap 39 may be between about 0 and 0.2 inch. The gap 39 may be selected to reduce the ability of the rim 37 to deform toward the reinforcing member 32 during shipping as desired.

The shipping package may contain stick electrodes 42 for welding as shown in FIG. 2. In one exemplary and non-limiting example, the can body 20 and end closure 28 are sized such that there is a gap between the end of the stick electrodes and the inside of the end closure 28 of between about 0.06 and 0.4 inches on at least one end of the shipping package. In one exemplary and non-limiting example, at least a portion of the support surface 29 is in contacting engagement with at least a portion of the exterior of the end closure 28 and positioned between about 0.008 inch and 0.4 inch from the end of the stick electrodes in the package on at least one end of the shipping package. Alternatively, at least a portion of the support surface 29 may be positioned between about 0.01 inch and 0.3 inch from the end of the stick electrodes in the package. In yet another alternative, at least a portion of the support surface 29 may be positioned between about 0.01 inch and 0.2 inch from the end of the stick electrodes in the package.

The can body 20 of the shipping package may include a closable end at both ends of the can body. The second closable end 26 may be closed using the end closure 28 and reinforced using the disposable reinforcing member 32 as shown in FIG. 2.

As shown in FIG. 3, the disposable reinforcing member 32 is positioned adjacent at least a portion of the exterior of the end closure 28 positioned to reinforce the end closure 28. The disposable reinforcing member 32 corresponding to at least a portion of the end closure may be secured by taping to the can body 20 using tape 38. As shown in FIG. 1, one or more pieces of tape 38 may be adhered to at least two sides of the can body 20 and at least a portion of the reinforcing member 32. Additional pieces of tape 38 may be applied as desired to secure the reinforcing member 32 to the shipping package. In one application, the tape 38 is a 3 inch wide shipping tape. Alternatively, the tape is a 2 inch wide tape. It is contemplated that the size of the tape may be varied as desired for satisfactory shipping performance.

Figure 4:
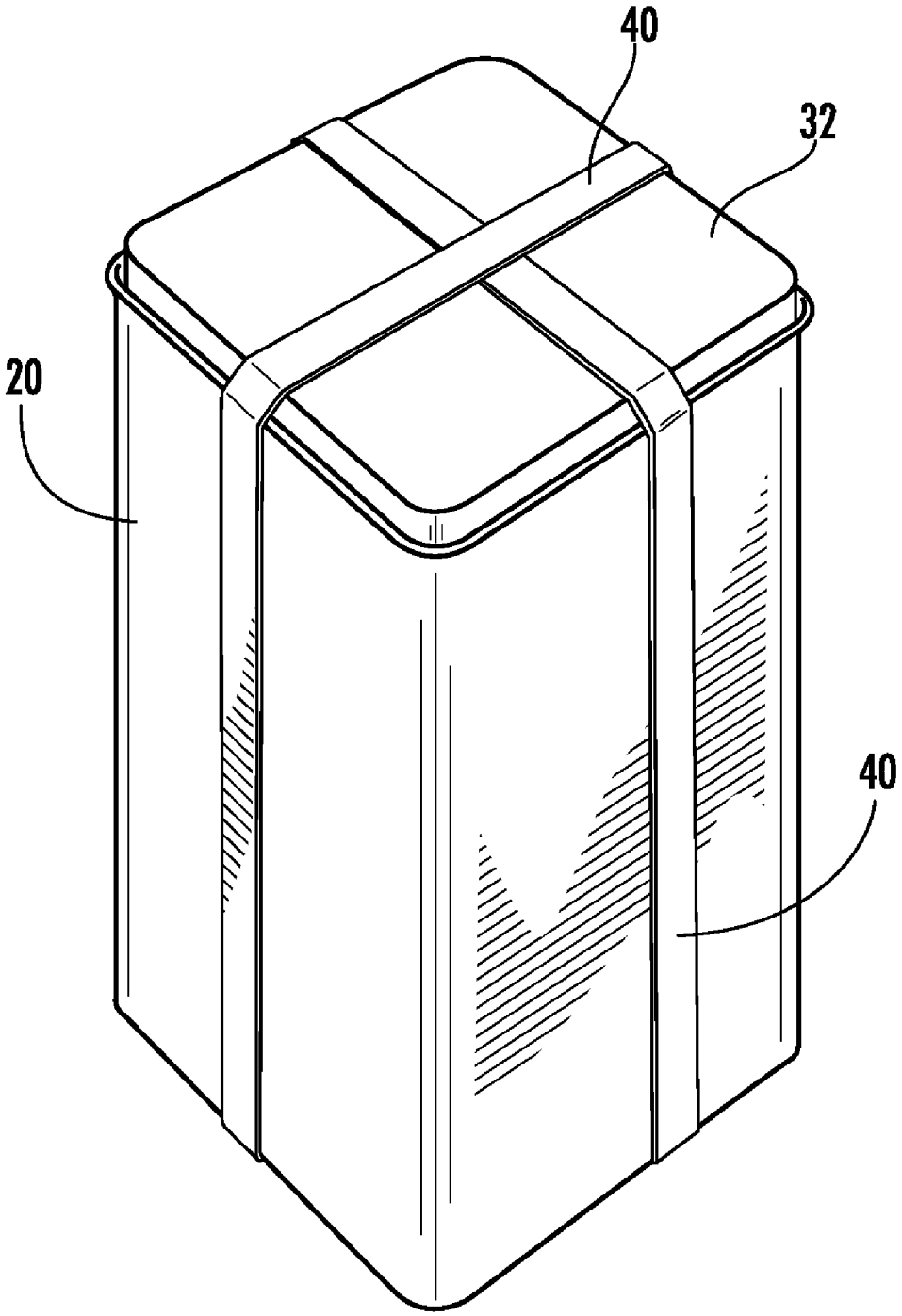
FIG. 4 is a perspective view of an alternative shipping package of the present disclosure.

Alternatively or additionally, the disposable reinforcing member 32 may be banded or strapped to the can body 20 using strapping 40. The strapping 40 may be wrapped around the shipping package forming a band. Additionally, the strapping 40 may be wrapped around the shipping package in two or more bands, such as around two opposite sides of the can body 20 in a first band, and around another two opposite sides of the can body 20 in a second band such as shown in FIG. 4. Additional bands of strapping 40 may be applied as desired to secure the reinforcing member 32 to the shipping package. In one application, the strapping 40 is ½ inch polypropylene strapping. Alternatively, the strapping is ⅜ inch polypropylene strapping. It is contemplated that the size and material of the strapping may be varied as desired for satisfactory shipping performance.

Figure 5:
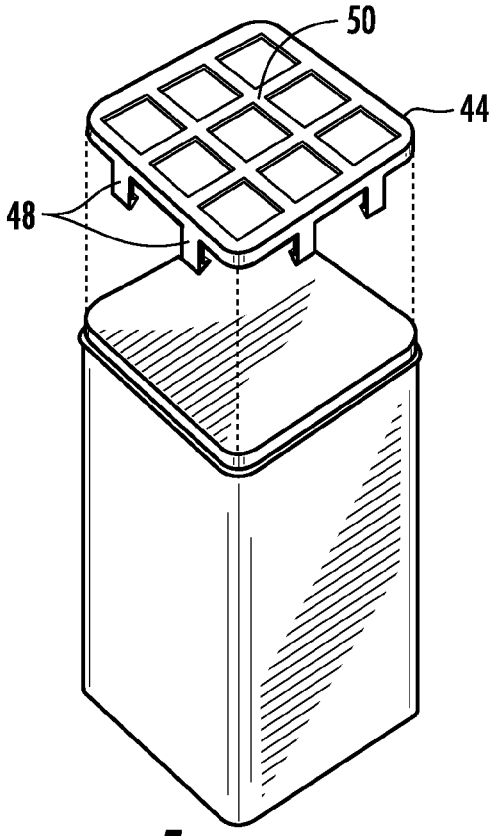
FIG. 5 is an exploded perspective view of an alternative shipping package of the present disclosure.
Figure 6:
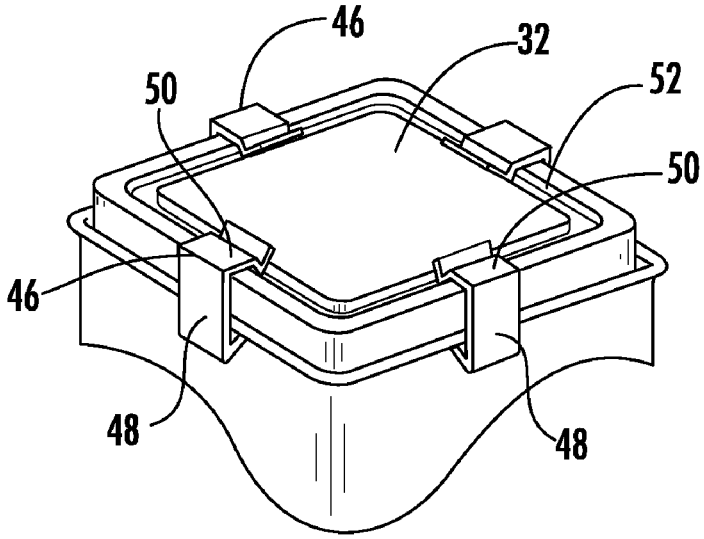
FIG. 6 is a perspective view of yet another alternative shipping package of the present disclosure.
Figure 7:
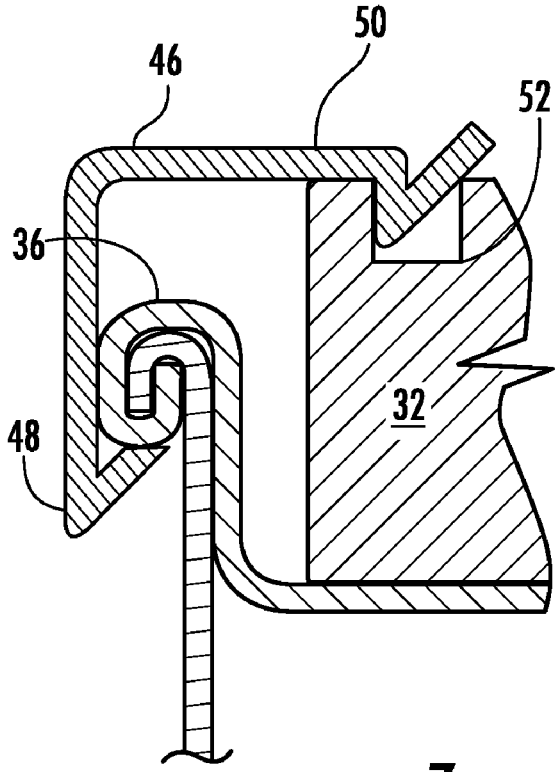
FIG. 7 is a partial cross sectional view of the shipping package of FIG. 6.

In one application, the disposable reinforcing member 32 may be secured adjacent at least a portion of the exterior side of the end closure using at least one clip, such as clip 44 adapted to secure the reinforcing member adjacent the end closure 28. As shown in FIG. 5, the clip 44 may be adapted to be positioned over at least a portion of the reinforcing member 32 to secure the reinforcing member 32 adjacent the end closure 28. An alternative clip 46 is shown in FIGS. 6 and 7. A plurality of clips, such as clips 46, may be provided to secure the reinforcing member 32 adjacent the end closure 28.

Figure 5A:
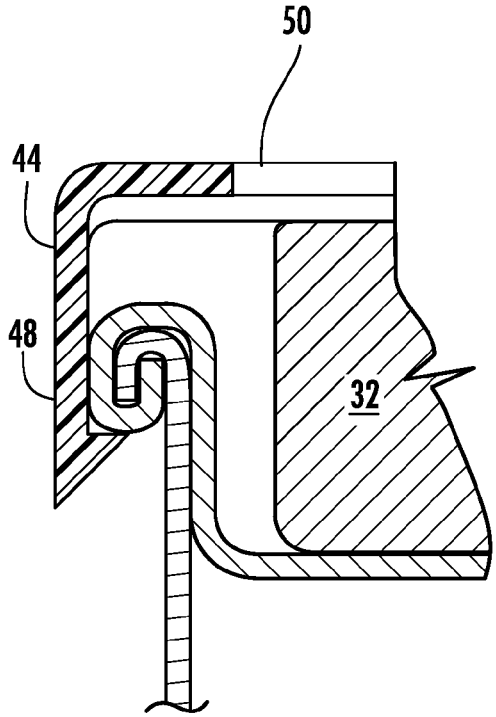
FIG. 5A is a cross sectional view through a clip of the shipping package of FIG. 5.

The clips 44, 46 may include at least one axial retaining portion 48 and a grip portion 50. As shown in FIGS. 5A and 6, the axial retaining portion 48 is adapted to prevent movement of the clip in the axial or longitudinal direction of the package. The axial retaining portion 48 may be adapted to engage a portion of the end closure 28, such as the flange 36 as shown in FIGS. 5A and 7. Alternatively, the axial retaining portion 48 may be adapted to engage a feature on the end closure 28 such as a rib, protrusion, recess, aperture, or other feature (not shown). Alternately, the axial retaining portion 48 may be adapted to engage the can body 20, such as to engage a rib, protrusion, recess, aperture, or other feature (not shown) provided on the can body 20.

Figure 5B:
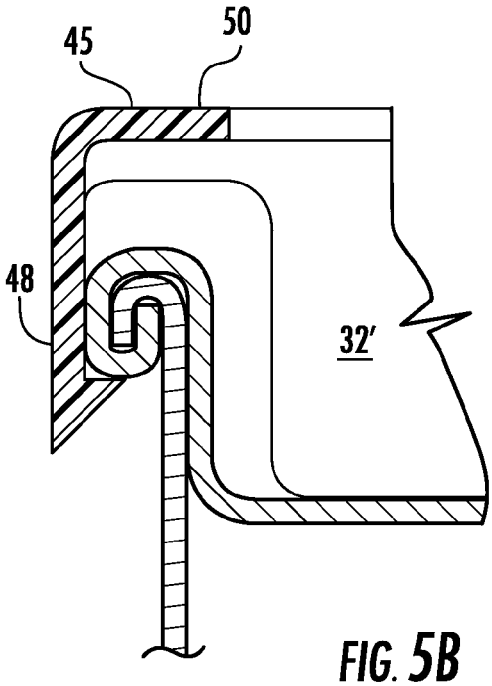
FIG. 5B is a cross sectional view through an alternative clip of the shipping package of FIG. 5.

The grip portion 50 of the clip 44, 46 may be adapted to engage at least a portion of the reinforcing member 32. As shown in FIGS. 5 and 5A, the grip portion 50 may be a cap-like structure that covers a portion of the reinforcing member 32. The clip 44 may be molded as one piece adapted to snap over the reinforcing member 32 and end closure 28 for shipping. Alternatively, as shown in FIGS. 6 and 7, the clip 46 may include a grip portion 50 adapted to engage a feature on the reinforcing member 32 such as a groove 52. Alternatively, the grip portion 50 may be adapted to engage a rib, protrusion, recess, aperture, or other feature (not shown) on the reinforcing member 32. Alternatively, the reinforcing member 32 may be formed integrally with the clip such as shown by exemplary clip 45 in FIG. 5B. In this application, the clip 45 may have a plurality of ribs 32' adapted to reinforce the end closure 28, the ribs 32' extending from the grip portion 50 to form contacting engagement with at least a portion of the exterior of the end closure 28.

The can body 20 may be made of steel. The can body 20 may be coated with a corrosion inhibitor such as galvanized, aluminized, tin-plated, epoxy-coated, painted, or other coating well known in the art. For certain lighter applications, the can body may be aluminum or thermoplastic.

The end closure 28 may be made of steel. The end closure 28 may be coated with a corrosion inhibitor such as galvanized, aluminized, tin-plated, epoxy-coated, painted, or other coating well known in the art. For certain lighter applications, the end closure 28 may be made of aluminum, thermoplastic such as polypropylene, PET, polyethylene, ABS, polystyrene, polyethylene, or other thermoplastic material, or other material suited to close the closeable end of the can body 20. In applications where the end closure and can body are thermoplastic, the end closure may be secured to the can body using ultrasonic welding, spin welding, adhesive, or other joining techniques for securing the end closure to the can body.

The disposable reinforcing member 32 may be made of particleboard, medium density fiberboard, oriented strand board, or chipboard. Alternatively, the disposable reinforcing member 32 may be made of wood plank, plywood, thermoset resin, thermoplastic, ceramic, or any material suited for reinforcing the end closure 28 from impact forces applied from within the package.

Figure 8:
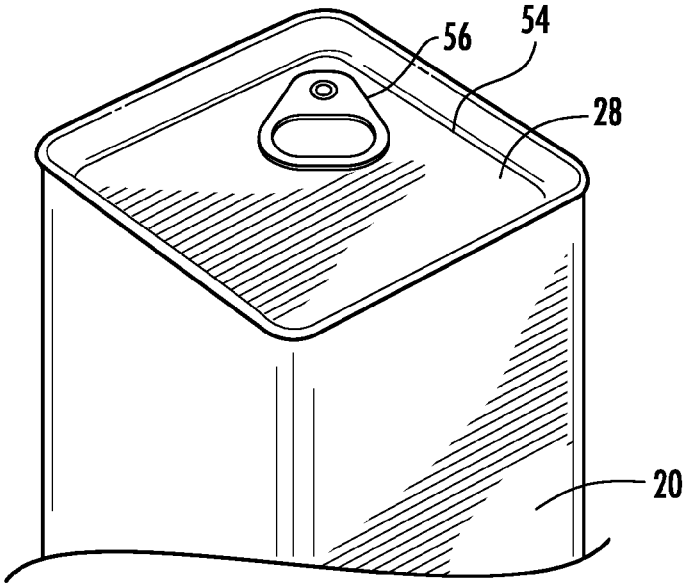
FIG. 8 is a perspective view of an alternative shipping package of the present disclosure.
Figure 9:
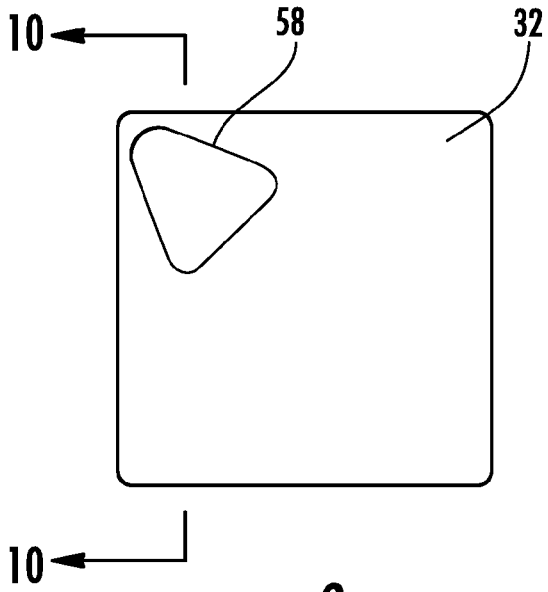
FIG. 9 is an bottom view of an alternative disposable reinforcing member of the present disclosure.
Figure 10:
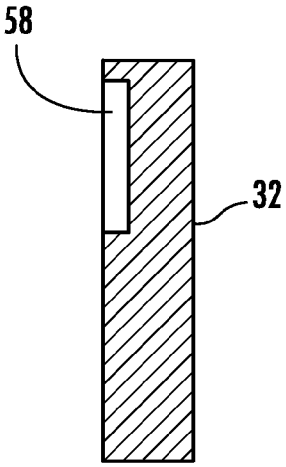
FIG. 10 is a cross sectional view of the reinforcing member of FIG. 9.

In some applications, the end closure 28 may include an easy-opening access 54 as shown in FIG. 8, such as a score line defining an area in the end closure 28 adapted to tear away along the score line by pulling a pull tab 56. As shown in FIGS. 9 and 10, the underside surface of the disposable reinforcing member 32 may include a recess 58 corresponding to the pull tab 56 such that the reinforcing member 32 provides contact with at least a portion of the exterior surface of the end closure 28 without interference with the pull tab. The depth of the recess 58 may be adapted such that the pull tab 56 contacts at least a portion of the inner surface of the recess 58.

Figure 11:
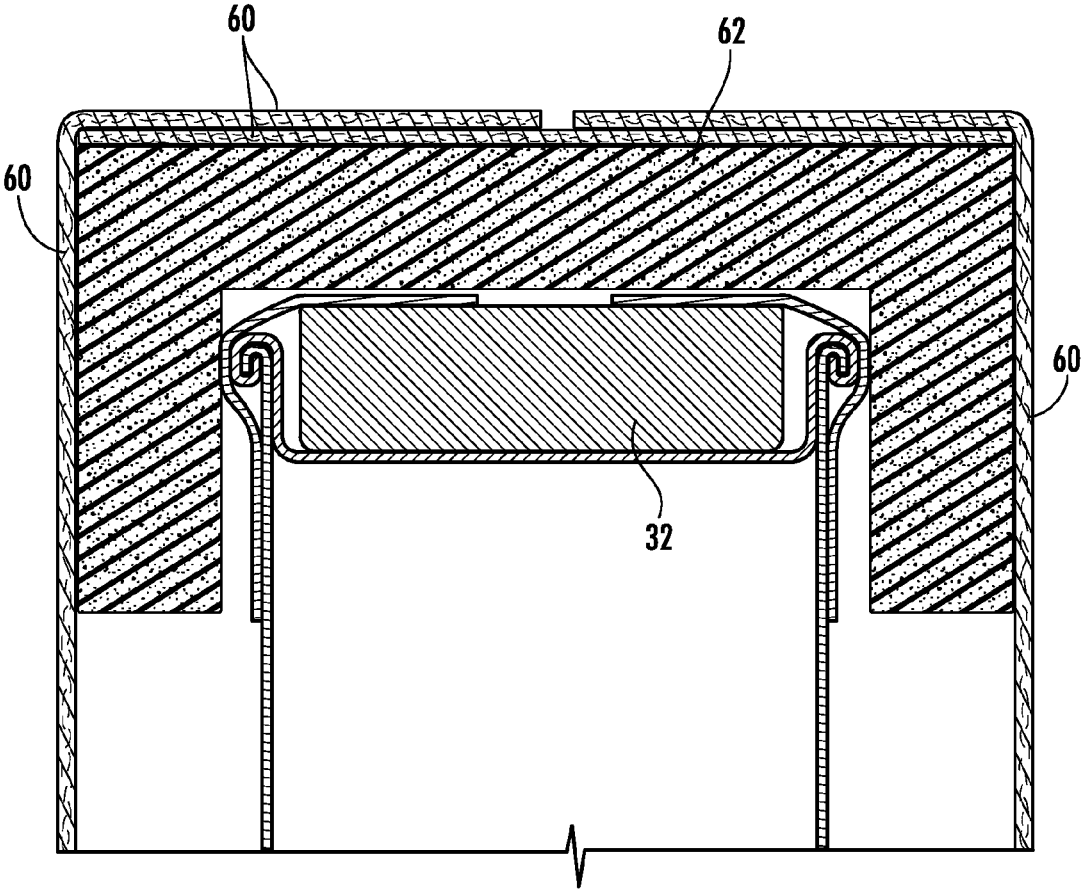
FIG. 11 is a cross sectional view through the end of a shipping package of the present disclosure with an outer packaging.

The present shipping package may further include outer packaging such as an overpack corrugated carton 60 as shown in FIG. 11. The outer packaging may further include additional packaging materials between the outside surface 24 of the can body 20 and the overpack carton. Alternatively or additionally, the outer packaging may further include additional packaging materials between the disposable reinforcing member 32 and the overpack carton 60. In one application, a cushioning member 62 may be provided between disposable reinforcing member 32 and the overpack carton. The cushioning member 62 may be made from at least one material selected from the group consisting of corrugated fiberboard, polystyrene foam, polyurethane foam, rubber, thermoplastic elastomer, and/or other cushioning material. In one exemplary and non-limiting example shown in FIG. 11, the cushioning member 62 may extend at least along a portion of the can body 20 such as an end cap. It is contemplated that the size of the cushioning member 62 may be varied as desired for satisfactory shipping performance.

In one application, the shipping package contains stick electrodes 42 for welding. The reinforcing member 32 is useful in reducing shipping damage for packages of stick electrodes 42 as the longitudinal rod shape and density of electrode products tends to increase forces applied to the end closure during shipping.

The disposable reinforcing member 32 is adapted to reduce shipping damage as measured, for example, by International Safe Transit Association (ISTA) Test Procedure 3a. In one application, the present shipping package containing 50 pounds of stick electrodes for welding with outer packaging was tested using ISTA Test Procedure 3a, shock test blocks 3 and 9. The reinforcing member 32 provided support for the package to withstand the electrodes impacting against the end closure 28 with less than about 1/16 inch deflection of the end closure 28 measured adjacent the can rim, with no fracture of the score of the easy-opening access 54, if present, or any un-rolling of the seam. To summarize, ISTA Test Procedure 3a includes 13 procedures called test blocks. As stated above, test blocks 3 and 9 are shock tests. Test block 3 includes nine drops specified in the ISTA Standard 3A. Test block 3 includes drops on three bottom edges from 12 inches, drops on two bottom corners from 12 inches, one side edge drop from 12 inches, one top edge drop from 12 inches, one drop on the bottom from 12 inches, and one drop on the bottom from 24 inches. Test block 9 includes eight drops specified in the ISTA Standard 3A. Test block 9 includes drops on two bottom edges from 12 inches, one top edge drop from 12 inches, a drop on one bottom corner from 12 inches, drops on two different to corners from 12 inches, one drop on the bottom from 12 inches onto a hazard, and one drop on a most critical or damage prone flat panel from 24 inches.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected. Additional features of the invention will become apparent to those skilled in the art upon consideration of the description. Modifications may be made without departing from the spirit and scope of the invention.

What is claimed is:

1. A shipping package comprising:

a can body having an interior volume and at least one closable end, the shipping package containing stick electrodes for welding, an end closure closably engaging the closable end of the can body having a recessed portion having an exterior surface within a portion of the can body adjacent the closable end, and a substantially rigid disposable reinforcing member having a thickness with a support surface on one side and an outward surface opposite the support surface, the support surface corresponding to at least a portion of the recessed portion of the end closure, a portion of the disposable reinforcing member recessed with the end closure into the closable end of the can body secured with the support surface in contacting engagement with at least a portion of the exterior surface of the recessed portion and the outward surface opposite the support surface positioned outside of the end closure recessed portion, the reinforcing member reinforcing the end closure from impact forces applied from within the package.

2. The shipping package according to claim 1, where the reinforcing member is adapted to provide less than about 1/16 inch deflection of the end closure measured adjacent the can rim when tested according to ISTA Test Procedure 3a, shock test blocks 3 and 9.

3. The shipping package according to claim 1, where the disposable reinforcing member is adapted to be removed after shipping to access the end closure.

4. The shipping package according to claim 1, where the reinforcing member is secured to the can body by using at least one selected from the group consisting of taping, banding, and strapping.

5. The shipping package according to claim 1, where the reinforcing member is made from at least one material selected from the group consisting of particleboard, medium density fiberboard, oriented strand board, chipboard, wood plank, plywood, thermoset resin, thermoplastic, and ceramic.

6. The shipping package according to claim 1, further comprising at least one clip adapted to secure the reinforcing member adjacent the end closure.

7. The shipping package according to claim 1, where the end closure forms a hermetically sealed closure.

8. A shipping package comprising:

a can body having an interior volume and at least one closable end, means for closing the closable end of the can body recessed within a portion of the can body adjacent the closable end, and a substantially rigid means for reinforcing a recessed portion of the means for closing the closable end, the means for reinforcing a recessed portion having a thickness with a support surface on one side and an outward surface opposite the support surface, the support surface corresponding to at least a portion of the means for closing the closable end, a portion of the means for reinforcing being recessed in the recessed portion secured with the support surface in contacting engagement with at least a portion of the means for closing the closable end and the outward surface opposite the support surface positioned outside of the recessed portion, the means for reinforcing a recessed portion reinforcing the means for closing the closable end from impact forces applied from within the package.

9. The shipping package according to claim 8, where at least a portion of the means for reinforcing are recessed into the interior volume adjacent the closable end of the can body.

10. The shipping package according to claim 8, where the means for reinforcing is adapted to be removed after shipping to access the means for closing the closable end.

11. The shipping package according to claim 8, further comprising means for securing the reinforcing member to the can body.

* * * * *